US007152865B2

(12) United States Patent
Chen

(10) Patent No.: US 7,152,865 B2
(45) Date of Patent: Dec. 26, 2006

(54) HEEL ADJUSTABLE SKATE

(75) Inventor: Henry T. Chen, Taipei (TW)

(73) Assignee: Minson Enterprises Co., Ltd., Taipei (TW)

( * ) Notice: Subject to any disclaimer, the term of this patent is extended or adjusted under 35 U.S.C. 154(b) by 0 days.

(21) Appl. No.: 10/323,710

(22) Filed: Dec. 18, 2002

(65) Prior Publication Data

US 2004/0119251 A1 Jun. 24, 2004

(51) Int. Cl.
*A63C 1/26* (2006.01)

(52) U.S. Cl. ..... 280/11.26

(58) Field of Classification Search ..... 280/11.19, 280/11.231, 11.26, 11.27, 11.12; 36/97
See application file for complete search history.

(56) References Cited

U.S. PATENT DOCUMENTS

| | | | | | |
|---|---|---|---|---|---|
| 2,009,684 | A | | 7/1935 | Affronte | 36/2.5 |
| 2,497,175 | A | | 2/1950 | Mantos | 36/2.5 |
| 2,523,449 | A | | 9/1950 | Rosenzweig | 36/2.5 |
| 2,572,050 | A | | 10/1951 | Ornstein | 280/11.3 |
| 2,732,217 | A | * | 1/1956 | Dore | 280/11.26 |
| 2,734,284 | A | | 2/1956 | Seurbom | 36/2.5 |
| 3,007,706 | A | * | 11/1961 | Pullen | 280/11.26 |
| 3,389,481 | A | | 6/1968 | England | 36/2.5 |
| 3,993,318 | A | * | 11/1976 | Rothmayer | 280/11.26 |
| 4,304,417 | A | | 12/1981 | Hsieh | 280/11.26 |
| 4,328,627 | A | | 5/1982 | Sanders | 36/115 |
| 4,418,929 | A | | 12/1983 | Gray | 280/11.23 |
| 4,468,045 | A | | 8/1984 | Sarazen | 280/11.3 |
| 4,684,140 | A | * | 8/1987 | Olivieri | 280/11.26 |
| 4,708,352 | A | * | 11/1987 | Vullierme | 280/11.26 |
| 4,807,893 | A | | 2/1989 | Huang | 280/11.2 |
| 4,998,358 | A | | 3/1991 | Girardelli | 36/117 |
| D323,055 | S | | 1/1992 | Cavasin | D2/275 |
| D323,056 | S | | 1/1992 | Cavasin | D2/275 |
| D324,937 | S | | 3/1992 | Cavasin | D2/276 |
| 5,172,924 | A | | 12/1992 | Barci | 280/14.2 |
| 5,184,834 | A | | 2/1993 | Yu | 280/7.13 |
| 5,400,484 | A | | 3/1995 | Gay | 24/585 |
| 5,416,988 | A | | 5/1995 | Potter et al. | 36/89 |
| 5,484,149 | A | * | 1/1996 | Lee | 280/11.26 |
| 5,615,901 | A | | 4/1997 | Piotrowski | 280/7.14 |
| 5,645,288 | A | | 7/1997 | Lu | 280/11.26 |
| 5,678,833 | A | | 10/1997 | Olson et al. | 280/11.22 |
| 5,735,536 | A | | 4/1998 | Myers et al. | 280/7.13 |
| 5,762,346 | A | | 6/1998 | Conte | 280/11.22 |
| 5,765,870 | A | | 6/1998 | Riley | 280/825 |
| 5,775,705 | A | | 7/1998 | Cochimin | 280/7.1 |
| 5,794,362 | A | | 8/1998 | Polk, III et al. | 36/97 |
| 5,803,467 | A | | 9/1998 | Piotrowski | 280/7.14 |
| 5,842,293 | A | | 12/1998 | Young | 36/97 |

(Continued)

FOREIGN PATENT DOCUMENTS

| | | |
|---|---|---|
| FR | 2 668 072 | 10/1990 |

*Primary Examiner*—Frank Vanaman
(74) *Attorney, Agent, or Firm*—Westman, Champlin & Kelly, P.A.; Z. Peter Sawicki

(57) ABSTRACT

A skate includes a holder frame, a boot, and a locking mechanism. The boot comprises a toe box and a heel portion, wherein the toe box is fixedly attached to the holder frame and wherein the heel portion engages the holder frame such that the heel portion is capable of moving relative to the toe box for adjusting the size of the boot. The skate also comprises a locking mechanism that is operable to selectively position and retain the heel portion in more than one position with respect to the toe box by engagement with the holder frame, wherein the locking mechanism is activatable through a push button.

16 Claims, 5 Drawing Sheets

U.S. PATENT DOCUMENTS 5,899,006 A 5/1999 Donnadieu ..... 36/97
5,913,526 A 6/1999 Olson et al. ..... 280/11.22
5,924,218 A 7/1999 Dalvy et al. ..... 36/55
5,934,693 A 8/1999 Nicoletti ..... 280/11.22
5,951,028 A 9/1999 Lovitt et al. ..... 280/11.22
5,961,129 A * 10/1999 Post et al. ..... 280/7.13
5,971,406 A 10/1999 Lyman ..... 280/11.22
5,992,861 A 11/1999 Piotrowski ..... 280/7.14
5,993,585 A 11/1999 Goodwin et al. ..... 156/145
6,045,144 A * 4/2000 Wong ..... 280/11.26
6,050,004 A 4/2000 Miralles et al. ..... 36/97
6,050,574 A 4/2000 Olson et al. ..... 280/11.22
6,070,885 A 6/2000 Ferone ..... 280/11.19
6,073,941 A 6/2000 Hilgarth ..... 280/11.22
6,082,027 A 7/2000 Wagonhurst ..... 36/97
6,113,111 A 9/2000 Gierveld et al. ..... 280/11.15
6,173,975 B1 1/2001 Brandner ..... 280/11.22
6,193,277 B1 2/2001 Marasco et al. ..... 280/825
6,212,796 B1 4/2001 Kubelka ..... 36/50.1
6,213,479 B1 4/2001 Cochimin ..... 280/7.1
6,216,366 B1 4/2001 Donnadieu ..... 36/97
6,217,039 B1 4/2001 Iverson et al. ..... 280/11.26
6,241,264 B1 6/2001 Page ..... 280/11.19
6,247,707 B1 6/2001 Conte ..... 280/11.221
6,273,437 B1 8/2001 Lovitt et al. ..... 280/11.233
6,276,697 B1 8/2001 Lin ..... 280/11.26
6,308,965 B1 10/2001 Yang ..... 280/11.221
6,374,516 B1 4/2002 Bonaventure et al. ..... 36/115
6,402,163 B1 6/2002 Pratt ..... 280/11.26
6,422,578 B1 7/2002 Oh ..... 280/11.232
6,422,579 B1 7/2002 Lindblad ..... 280/11.26
6,425,587 B1 7/2002 Moon ..... 280/11.206
6,431,604 B1 8/2002 Goeckel ..... 280/811
6,438,872 B1 * 8/2002 Chil et al. ..... 36/97
6,574,888 B1 * 6/2003 Miller et al. ..... 36/97
6,612,592 B1 * 9/2003 Soo ..... 280/11.16

* cited by examiner

HEEL ADJUSTABLE SKATE

CROSS-REFERENCE TO RELATED APPLICATION(S)

None.

BACKGROUND OF THE INVENTION

The present invention relates to in-line skates and ice skates. In particular, the present invention relates to in-line skates and ice skates wherein the boot length is adjustable to accommodate different foot sizes.

In-line skating has become a popular recreational activity, especially for children. Moreover, ice skating has a long standing history as a popular pastime. However, children have growing feet and require skates that properly fit their feet. To be able to enjoy skating with properly fitting skates, new pairs of skates will need to be purchased, sometimes on an annual basis.

The following patents describe skates wherein the boot size is adjustable or the length of the skate is adjustable to accommodate a different boot size: Sartor et al., U.S. Pat. No. 5,408,763, Meibock et al., U.S. Pat. No. 5,452,907, MacPhail, U.S. Pat. No. 5,459,949, Lee, U.S. Pat. No. 5,484,149, Lu, U.S. Pat. No. 5,645,288, Olson et al., U.S. Pat. No. 5,678,833, Huang, U.S. Pat. No. 5,741,018, Klamer et al., U.S. Pat. No. Re. 32,346.

BRIEF SUMMARY OF THE INVENTION

The present invention includes a skate that has an adjustable boot, wherein a toe box is fixedly attached to a wheel holder frame, and a heel portion is movable with respect to the toe box for adjusting the size of the boot. The boot of the present invention also includes a locking mechanism operable to selectively position and retain the heel portion in more than one position with respect to the toe box by engagement with the wheel holder frame. The locking mechanism is activatable tluhough a push button. The present invention includes an advantageous skate that may be quickly and easily adjusted for different sized feet. The skate of the present invention may also incorporate a skate holder frame in lieu of the wheel holder frame for functioning as an ice skate.

DETAILED DESCRIPTION

Figure 1:
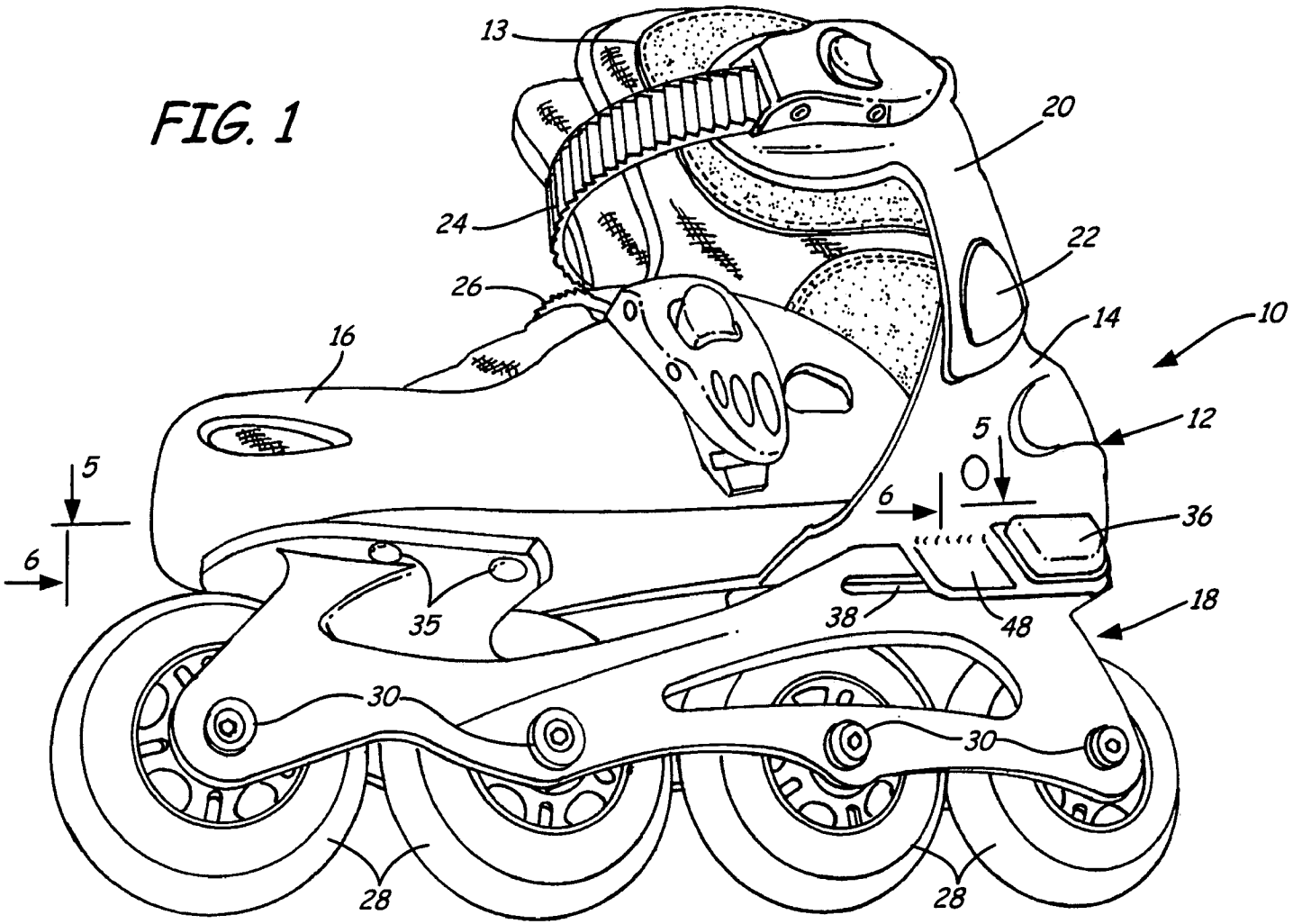
FIG. 1 is a perspective view of an in-line skate of the present invention.
Figure 2:
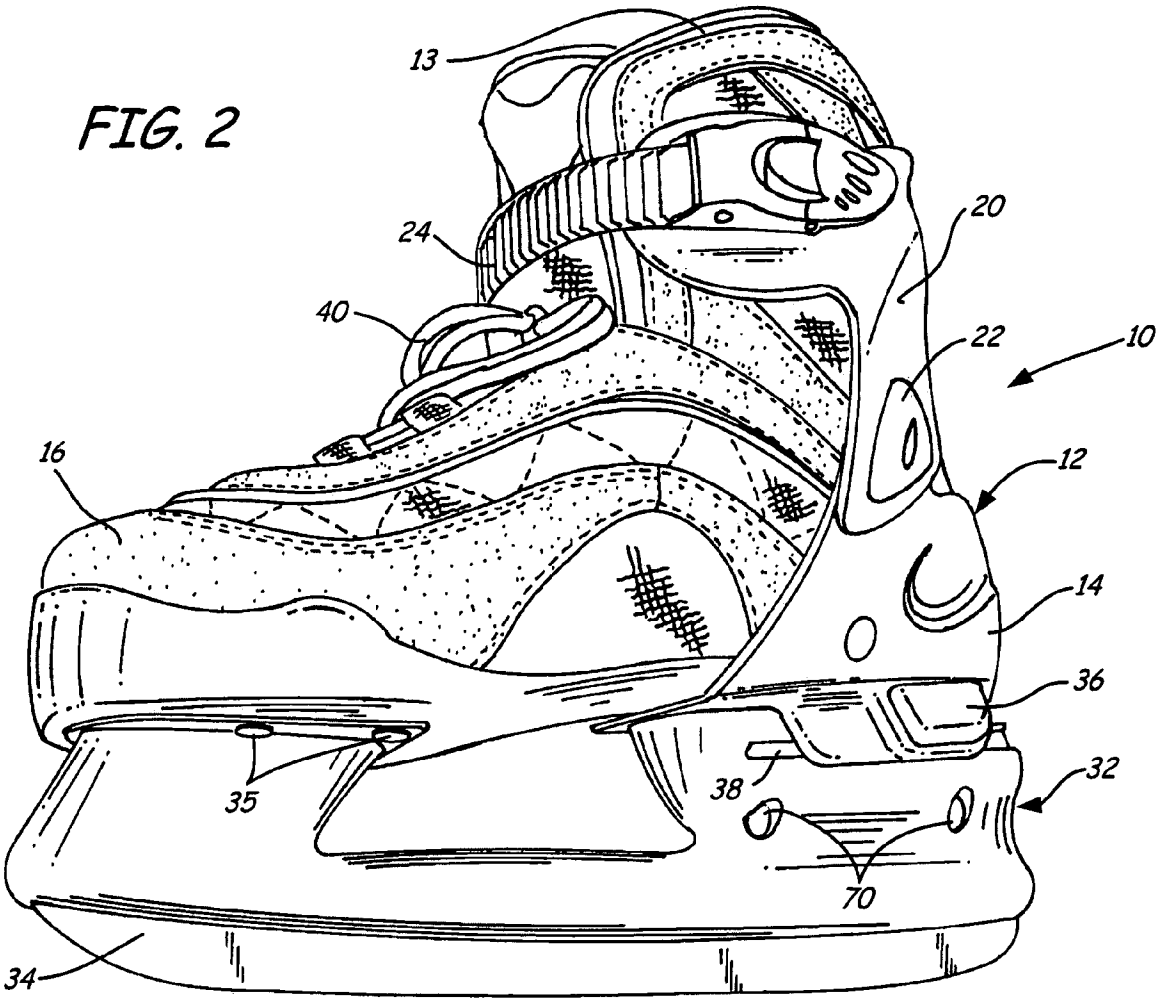
FIG. 2 is a perspective view of an ice skate of the present invention.
Figure 3:
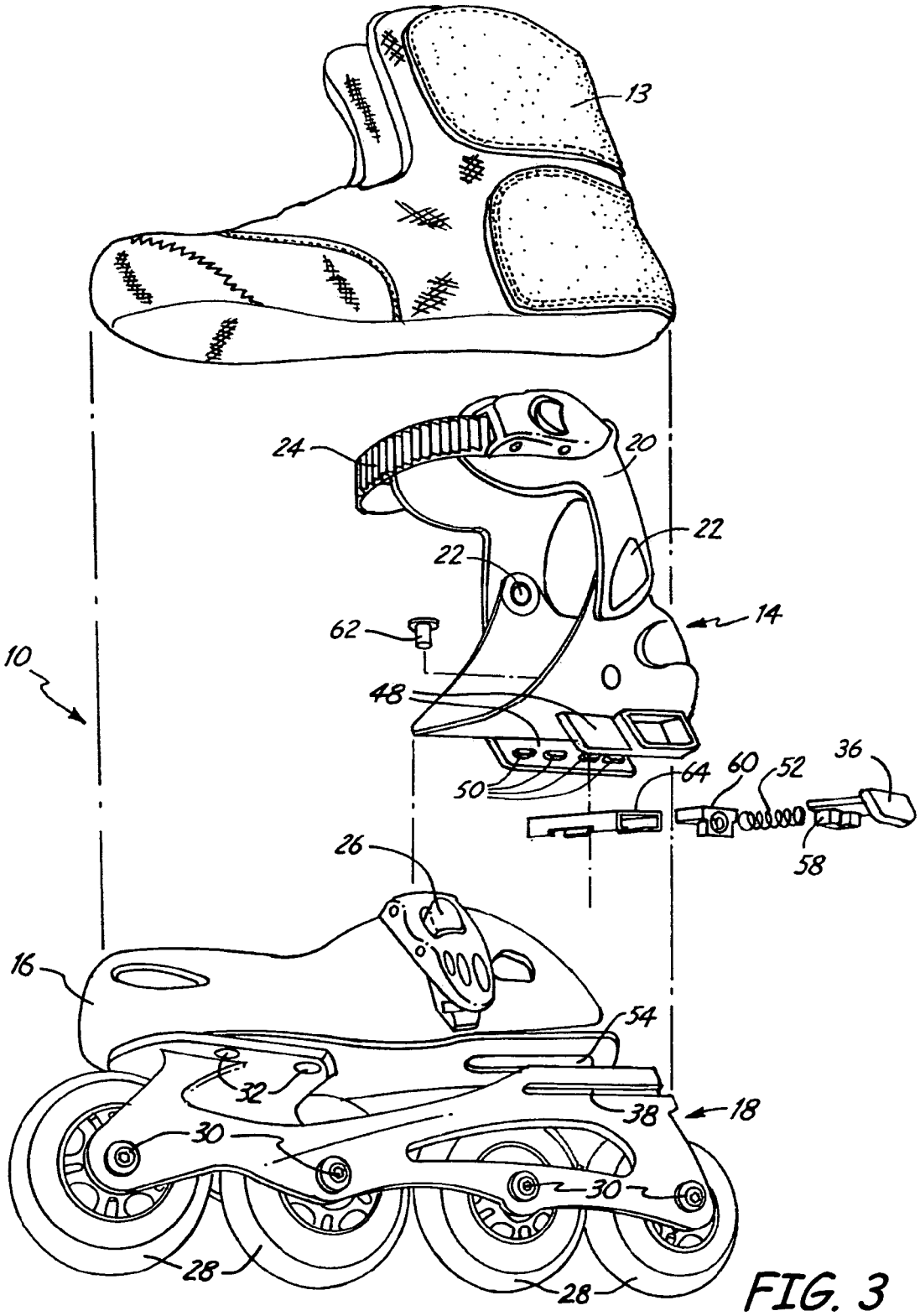
FIG. 3 is an exploded perspective view of the present invention of FIG. 1.

A skate of the present invention is generally illustrated at 10 in FIGS. 1–3. As illustrated in FIG. 1, the skate 10 includes a boot 12 having a liner 13, and a wheel holder frame 18. The boot 12 includes a heel portion 14, a toe box 16, and a cuff portion 20, and is slidably attached to the wheel holder frame 18. The heel portion 14 slides relative to the toe box 16 so that the size of the boot 12 is adjustable. A locking mechanism is also included for moving and retaining the heel portion 14 at multiple positions relative to the toe box 16. This allows the boot 12 to be adjusted to accommodate feet of different sizes and is especially advantageous for young wearers whose feet grow rapidly. As a person's feet grow, the boot 12 may be adjusted to fit the larger foot size, preventing the need to purchase a new set of skates.

The cuff portion 20 is pivotally connected to the heel portion 14 in a conventional manner via a pair of pivots 22, where each pivot 22 is located on opposing sides of the cuff portion 20. The cuff portion 20 also includes a cuff buckle 24, which is a conventional buckle used to secure the cuff portion 20 to a wearer's leg. The toe box 16 includes a forward buckle 26, which is a conventional buckle used to secure the toe box 16 to a wearer's foot.

The wheel holder frame 18 retains a plurality of wheels 28, which are rotatably secured to the wheel holder framel 8 by fasteners 30, as is well known in the art. Alternatively, as illustrated in FIG. 2, a skate holder frame 32 may be incorporated in lieu of the wheel holder frame 18. The skate holder frame 32 retains an ice skate blade 34 as well known in the art.

The skate 10 may also incorporate a braking mechanism (not shown) that fastens to the wheel holder frame 18 at the end of the wheel holder frame 18 proximate the heel portion 14, as is well known in the art.

The toe box 16 is fixedly attached to the wheel holder frame 18 preferably via a pair of mounting fasteners 35. A second pair of mounting fasteners 35 (not shown) are located on the opposing side of the wheel holder frame 18. Alternatively, the toe box 16 and the wheel holder frame 18 may be integrally formed.

The toe box 16 may be manufactured in various designs and styles. For example, FIG. 1 illustrates the toe box 16 as a flexible plastic-molded component. This is additionally advantageous for the adjustable boot 12 because the toe box 16 is also capable of being adjustable for different foot sizes by being able to flex when the forward buckle 26 secures the toe box 16 to a wearer's foot. Alternatively, FIG. 2 illustrates the toe box 16 as a shoe-like component. With the shoe-like toe box 16, a set of straps 40 can be incorporated in lieu of the forward buckle 26. The straps 40 are conventional straps used to secure the toe box 16 to a wearer's foot.

The liner 13, as illustrated in FIG. 1, is removably disposed within the boot 12 and extends into the toe box 16, the heel portion 14, and out through the cuff portion 20. Suitable liners such as liner 13 are well known in the art. Additionally, in lieu of being removably disposed within the boot 12, the liner 13 as illustrated in FIG. 2 may be fastened to both the heel portion 14 and the toe box 16. The liner 13 is used in conjunction with the shoe-designed toe box 16, which does not require the liner 13 to cover a wearer's entire foot. Instead, the liner 13 ends at a wearer's mid-foot and has extensions fastening to the inner-side walls of the toe box 16. The liner 13 in this embodiment has elastic portions to accommodate a length adjustment in the boot 12. When the heel portion 14 is adjusted to lengthen the boot 12, the liner 13 stretches at the elastic portions to be wearable with the boot 12 at a larger size.

The heel portion 14 is slidably attached to the wheel holder frame 18. The wheel holder frame 18 and the skate holder frame 32 include tracks 38, which are grooved tracks running along each side of the upper rear portions of the wheel holder frame 18 and the skate holder frame 32. The heel portion 14 includes a pair of wings 48, which are appendages that extend downward in a parallel manner from the heel portion 14, as illustrated in FIG. 3. The wings 48 include sets of slide tabs 50, which are rows of tabs attached to the inner side of each wing 48, such that the two rows of slide tabs 50 face each other. The rows of slide tabs 50 are insertable into the pair of tracks 38 so that the heel portion 14 is slidably attached to the wheel holder frame 18. When the heel portion 14 is slidably attached to the wheel holder frame 18, the rear portions of toe box 16 extend into and within the heel portion 14, as best illustrated in FIGS. 1 and 2. Thus, the heel portion 14 is capable of moving relative to the toe box 16, allowing the boot 12 to be adjustable in length.

The heel portion 14 additionally includes a push button 36 located on a single side of the heel portion 14. More specifically, the push button 36 is inserted through the wing 48 on a single side of the heel portion 14 to engage a locking mechanism. Activation of the push button 36 allows the heel portion 14 to slide relative to the toe box 16 and the wheel holder frame 18 for adjusting the length of the boot 12. When the push button 36 is not activated, the locking mechanism prevents the heel portion 14 from sliding and retains the heel portion 14 in a single position relative to the toe box 16 and the wheel holder frame 18. Therefore, the use of the push button 36 allows the boot 12 to be quickly and easily adjusted in length.

Figure 4:
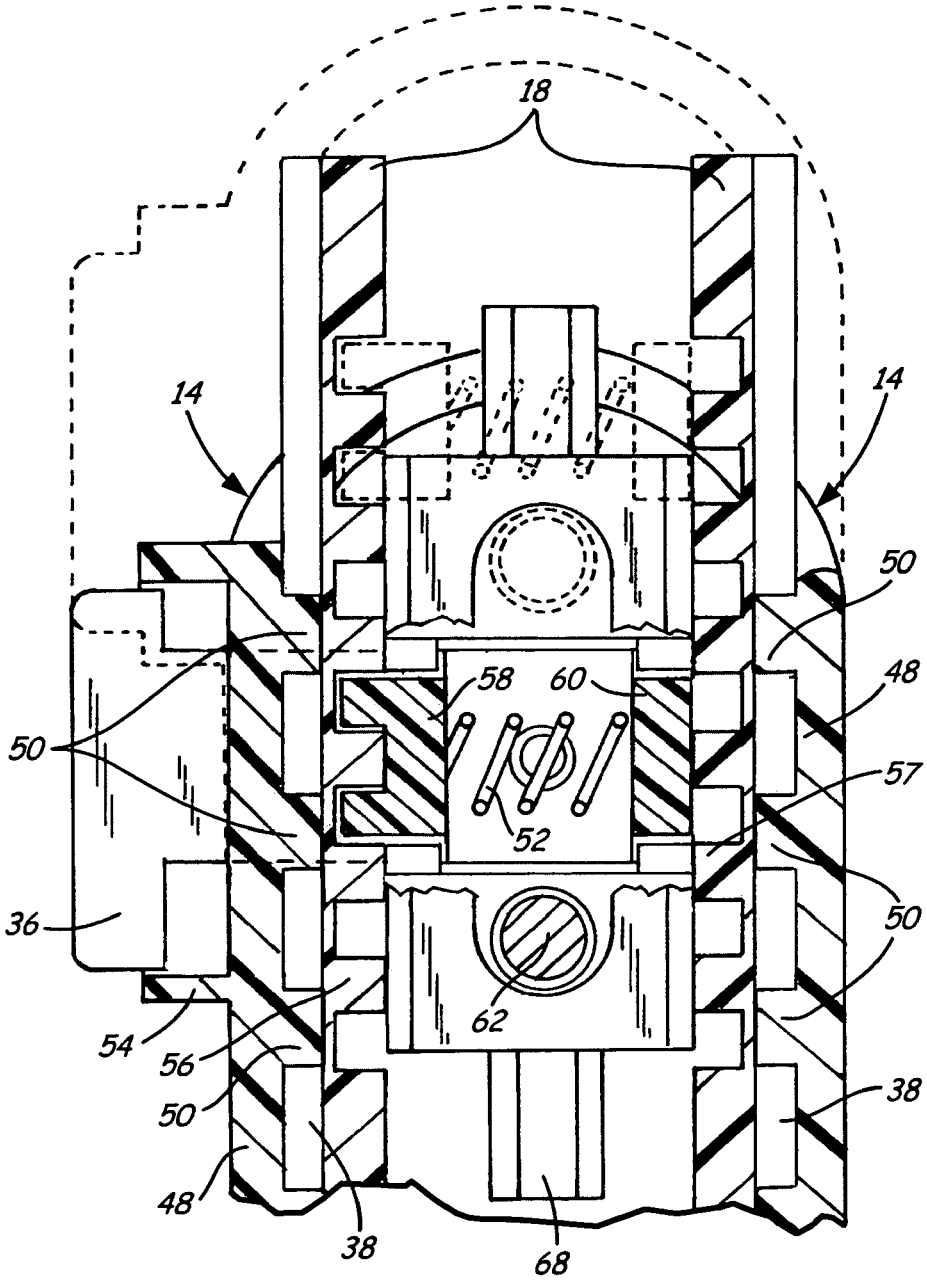
FIG. 4 is a sectional view taken along line 4—4 in FIG. 1.
Figure 5:
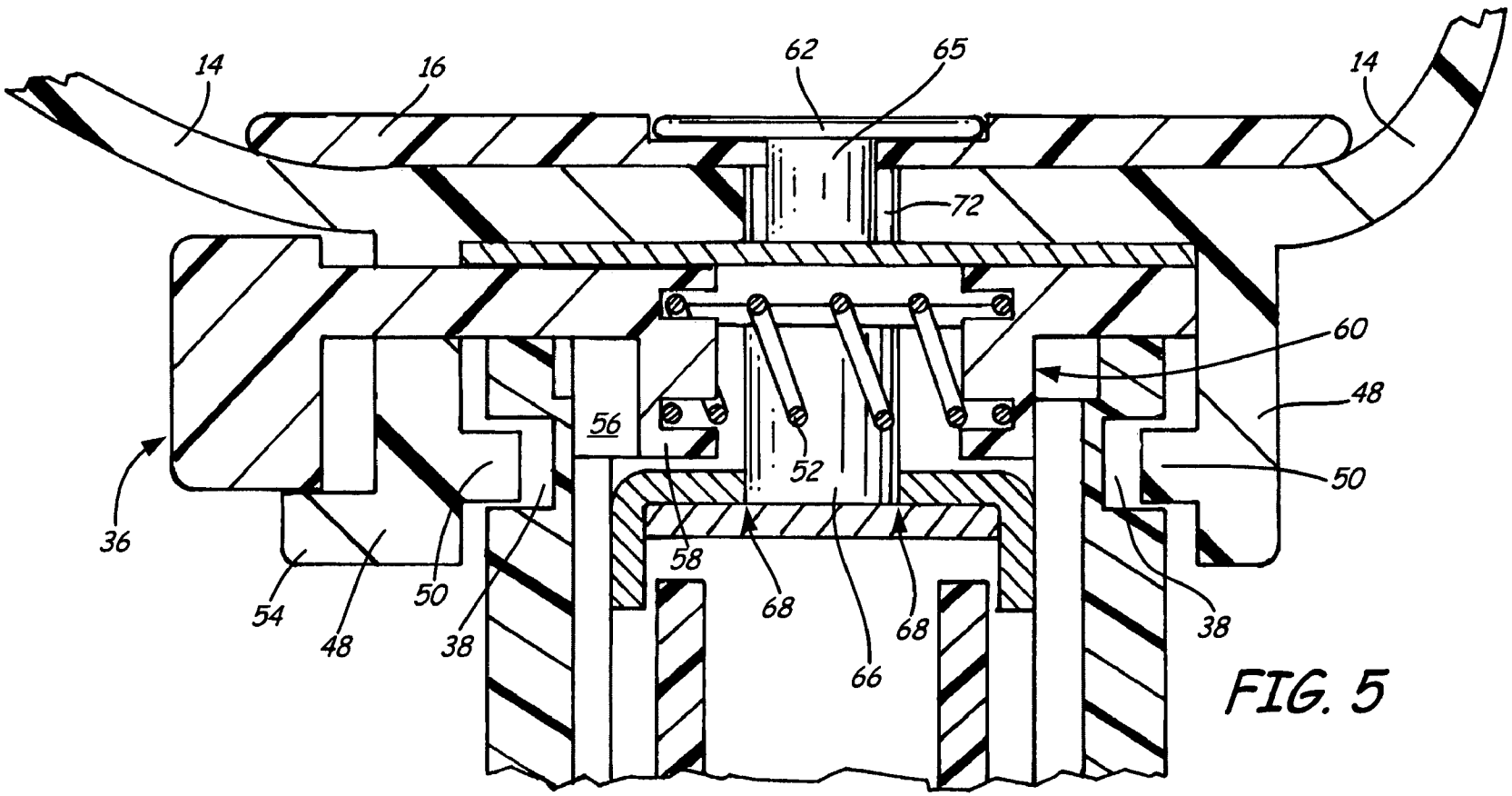
FIG. 5 is a sectional view taken along line 5—5 in FIG. 1.

The locking mechanism, as illustrated in FIGS. 4 and 5, includes the push button 36, a spring 52, a row of locking teeth 56, a spring lock 58, a counter support 60, and a guide rail 64. The locking mechanism is a spring-lock mechanism, where the spring 52 forces the spring lock 58 to engage with a row of locking teeth 56 integrally formed in the wheel holder frame 18. When the spring lock 58 and the locking teeth 56 are engaged, the heel portion 14 is prevented from sliding relative to the toe box 16 and the wheel holder frame 18. Activation of the push button 36 counters the force applied by the spring 52, and disengages the spring lock 58 from the locking teeth 56. When the spring lock 58 and the locking teeth 56 are disengaged, the heel portion 14 is capable of moving relative to the toe box 16 and the wheel holder frame 18 by sliding along the tracks 38. The serrated lines in FIG. 4 illustrate the direction of movement of the heel portion 14 relative to the wheel holder frame 18.

The locking teeth 56 are intermittent teeth, preferably integrally formed with the wheel holder frame 18, which create a row of mechanically locking teeth as illustrated in FIG. 4. Alternatively, the locking teeth 56 may be separate components that are securely attached to the wheel holder frame 18. The push button 36 extends through the wing 48 as illustrated in FIG. 5 and ends in the spring lock 58. The spring lock 58 may be integrally formed with the push button 36 or may be a separate component connected to the push button 36. The spring lock 58 also includes teeth, preferably integrally formed with the spring lock 58, which are positioned to line up with the row of locking teeth 56. When lined up, the teeth of the spring lock 58 are insertable in the intermittent spaces between the locking teeth 56, allowing the spring lock 58 to engage with the locking teeth 56.

The spring lock 58 also engages the spring 52 on the side opposing the integrally formed teeth. The spring 52 engages the counter support 60 as well, on the opposing end from the spring lock 58, as illustrated in FIGS. 4 and 5. In addition, the spring 52, the spring lock 58, and the counter support 60 are held in alignment by the guide rail 64. The guide rail 64 is a support component attached to the bottom of the heel portion 14 that restricts the movement of the slide lock 58 to a single direction.

The counter support 60 is a base for the spring 52 to exert force to engage the spring lock 58 with the locking teeth 56. The spring lock 56 and the counter support 60 both contain grooves or pegs to restrain the spring 52 in position to ensure that the spring 52 does not disengage from the spring lock 58 or the counter support 60.

In use, the spring 52 exerts a force against the spring lock 58, forcing the spring lock 58 to engage the locking teeth 56. The spring lock 58 is restrained by the guide base 64 and the guide base 64 is connected to the heel portion 14. Correspondingly, the locking teeth 56 are integrally formed into the wheel holder frame 18. Therefore, when the spring lock 58 engages the locking teeth 56, the heel portion 14 is locked to the wheel holder frame 18. This prevents the heel portion 14 from being adjusted relative to the wheel holder frame 18 and the toe box 16, and maintains the length of the boot 12.

Activation of the push button 36 allows the heel portion 14 to be movable relative to the wheel holder frame 18 and the toe box 16. The push button 36 is activated by being pressed on. When activated, the push button 36 forces the spring lock 58 to disengage from the locking teeth 56, and to compress the spring 52 against the counter support 60. While the spring lock 58 is disengaged from the locking teeth 56, the heel portion 14 is not locked to the wheel holder frame 18. As such, while the push button 36 is activated, the heel portion 14 is capable of moving relative to the toe box 16 for adjusting the size of the boot 12.

Release of the push button 36 removes the compression applied to the spring 52. The spring 52 then is able to force the spring lock 58 to re-engage the locking teeth 56 by forcing the teeth of the spring lock 58 back into the intermittent spaces between the locking teeth 56. This locks the heel portion 14 to the wheel holder frame 18 and retains the heel portion 14 in a single position. Thus, the locking mechanism allows a wearer to position and retain the heel portion 14 in more than one position with respect to the toe box 16.

The wheel holder frame 18 also includes a row of locking teeth 57, despite the fact that the locking teeth 56 are the only row used with the locking mechanism. The locking teeth 57 are located across the locking mechanism from the locking teeth 56. The locking teeth 57 exist because the wheel holder frame 18 is a universal design. That is, the wheel holder frame 18 is capable of being used with a push button 36 located on either the right or left side of the heel portion 14. This is beneficial to decrease manufacturing costs of the wheel holder frame 18 by incorporating a universal design.

While the heel portion 14 is capable of moving relative to the toe box 16 and the wheel holder frame 18, the range of movement is limited through the use of an upper guide channel 54, a boot screw 62, a rivet 65, a boot nut 66, a lower guide channel 68, and a bore 72. The upper guide channel 54 is a slot in the rear sole of the toe box 16, as best illustrated in FIG. 3. The upper guide channel 54 is included in the portion of the toe box 16 that extends within the heel portion 14. The lower guide channel 68 is a slot similar in size to the upper guide channel 54, and is located in the upper rear portion of the wheel holder frame 18 such that when the toe box 16 is fixedly attached to the wheel holder frame 18, the upper guide channel 54 and the lower guide channel 68 are vertically lined up. The upper guide channel 54 and the lower guide channel 68 define the range the heel portion 18 is capable of moving relative to the toe box 16 and the wheel holder frame 18.

The boot screw 62 is inserted vertically downward through the upper guide channel 54, through the bore 72, which is located within the sole of the heel portion 14, and through the rivet 65 as illustrated in FIG. 5. The rivet 65 functions as a standoff and protects the boot screw 62 from external elements. When inserted, the boot screw 62 extends vertically downward adjacent to the locking mechanism, and is capped with the boot nut 66. Boot nut 66 extends vertically upward through the lower guide channel 68 for screwing onto the boot screw 62.

The boot screw 62, when fully inserted, extends through the heel portion 14 at the bore 72, and correspondingly moves along with the heel portion 14. The boot screw 62, is limited to a range determined by the lengths of the upper guide channel 54 and the lower guide channel 68. When the heel portion 14 is move towards the toe box 16, the boot screw 62 eventually reaches an end of the upper guide channel 54 and the lower guide channel 68. The reciprocal ends are reached if the heel portion 14 is moved away from the toe box 16. Therefore, the boot screw 62 limits the range of movement of the heel portion 14, and correspondingly sets the limit on the range of foot sizes the boot 12 may be adjusted to. The use of boot screw 62 also provides added security for preventing the heel portion 14 from sliding off from the tracks 38 of the wheel holder portion 18.

A modification of the lower guide channel 68 may also be used in conjunction with the skate holder frame 32. When the boot screw 62 is used with the wheel holder frame 18 in an in-line skate, the underside of the lower guide channel 68 of the wheel holder frame 18 is readably accessible for insertion of the boot nut 66. As illustrated in FIG. 1, there are voids between the wheels 28 where the boot nut 66 can easily be inserted. However, as illustrated in FIG. 2, there are no corresponding voids in the skate holder frame 32. As such, there is no accessible location for the lower guide channel 68 with the skate holder frame 32.

To overcome this complication, a base containing the lower guide channel 68 (not shown) is insertable into the rear portion of the skate holder frame 32. The base is attached to the skate holder frame 32 with fasteners at a pair of holes 70, which are inserted into the skate holder frame 32 below the tracks 38. An additional pair of holes 70 (not shown) are also located on the opposing side of the skate holder frame 32.

Before attaching the component with the lower guide channel 68, the boot nut 66 is inserted vertically upwards through the lower guide channel 68 so that the boot nut 66 is available for securing the boot screw 62. This modification allows the use of the boot screw 62 and the lower guide channel 68 to limit the range of movement of the heel portion 14, despite the design complications involved with ice skates.

The skate 10 is an advantageous sporting device that is capable of quick and easy adjustments in length. By being adjustable in length, the skate 10 is beneficial for wearers whose feet grow rapidly. Additionally, the push button 36 provides the advantage of quick and easy adjustments. A wearer need only to activate the single push button 36 and slide the heel portion 14 along the tracks 38. When the desired length is achieved, the wearer then releases the push button 36, locking the heel portion 14 to the wheel holder frame 18 to maintain the desired length for use.

Although the present invention has been described with reference to the preferred embodiments, workers skilled in the art will recognize that changes may be made in form and detail without departing from the spirit and scope of the invention.

The invention claimed is:

1. A skate comprising:

a holder frame having two sets of a plurality of teeth, each set positioned along an opposing side of the holder frame, each set of teeth having surfaces on distal ends and spaces between the plurality of teeth;

a boot comprising a toe box and a heel portion, wherein the toe box is fixedly attached to the holder frame, and wherein the heel portion engages the holder frame such that the heel portion is capable of moving relative to the toe box for adjusting the size of the boot;

a push button locking mechanism positioned on either the left or right side of the heel portion and operable to selectively position and retain the heel portion in more than one position with respect to the toe box and including a locking member for engaging the spaces between the plurality of teeth of the holder frame whether the push button is positioned on the left or right side of the heel portion, and wherein the push button locking mechanism is retained within the heel portion by engagement of an end of the push button locking mechanism with the surfaces of the plurality of teeth; and a removable fastener capable of being inserted into and removed from the heel portion, toe box, and holder frame, wherein the heel portion is prevented from moving relative to the toe box when the removable fastener is inserted into the heel portion, toe box, and holder frame.

2. The skate of claim 1, wherein the holder frame is a wheel holder frame such that the skate is a roller skate.

3. The skate of claim 1, wherein the holder frame is a skate holder frame such that the skate is an ice skate.

4. A skate comprising:

a holder frame; and a boot comprising a toe box and a heel portion;

wherein the toe box is fixedly attached to the holder frame, and wherein the heel portion engages the holder frame such that the heel portion is capable of moving relative to the toe box for adjusting the size of the boot;

wherein the holder frame comprises two tracks of locking teeth on two sides and having surfaces at distal ends, and wherein the heel portion comprises a lock engageable and disengageable with one of the two tracks of locking teeth regardless of whether the lock is positioned on the right or left side of the heel portion such that when the lock engages one of the tracks of locking teeth, the heel portion is prevented from moving relative to the toe box, and wherein an end of the lock engages the surfaces of the teeth to retain the lock therein; and a removable fastener capable of being inserted into and removed from the heel portion, toe box, and holder frame, wherein the heel portion is prevented from moving relative to the toe box when the removable fastener is inserted into the heel portion, toe box, and holder frame.

5. The skate of claim 4, wherein the holder frame is a wheel holder frame such that the skate is a roller skate.

6. The skate of claim 4, wherein the holder frame is a skate holder frame such that the skate is an ice skate.

7. The skate of claim 4 further comprising a spring engaging the lock, wherein the spring provides a force to cause the lock to engage the track of locking teeth.

8. The skate of claim 7 further comprising a push button engaging the lock, wherein activation of the push button counters the spring force and disengages the lock from the track of locking teeth.

9. The skate of claim 7, wherein the spring provides a force to the lock in a direction parallel to a plane of engagement between the heel portion and holder frame.

10. The skate of claim 9, wherein the spring provides a force against the lock in a direction perpendicular to the direction the heel portion is capable of moving relative to the toe box.

11. The skate of claim 10 further comprising a push button engaging the lock, wherein activation of the push button counters the spring force and disengages the lock from the track of locking teeth.

12. A skate comprising:

a holder frame comprising a first end, a second end having two opposing sides, and two sets of locking teeth with one set of teeth positioned on two opposing sides of the second end of the holder frame, and the teeth having surfaces at distal ends and spaces between the teeth;

a toe box fixedly attached to the first end of the holder frame;

a heel portion slidably engaging the second end of the holder frame; and a locking mechanism comprising a push button engaging the heel portion and positioned on either a right or left side of the heel portion, a spring lock connected to the push button, and a spring engaging the spring lock, wherein the spring lock is engageable and disengageable with the locking teeth whether the push button is positioned on a left or right side of the heel portion;

wherein the spring engages the spring lock with the locking teeth preventing the heel portion from moving relative to the toe box, and wherein an end of the spring lock abuts the surfaces of one set of the locking teeth to retain the spring lock within the heel portion;

and wherein activation of the push button disengages the lock from the locking teeth by moving the lock from the spaces between the other set of teeth such that the heel portion is capable of moving relative to the toe box for adjusting the size of the skate; and a removable fastener capable of being inserted into and removed from the heel portion, toe box, and holder frame, wherein the heel portion is prevented from moving relative to the toe box when the removable fastener is inserted into the heel portion, toe box, and holder frame.

13. The skate of claim 12, wherein the holder frame is a wheel holder frame such that the skate is a roller skate.

14. The skate of claim 13, wherein the skate is an in-line roller skate.

15. The skate of claim 12, wherein the holder frame is a skate holder frame such that the skate is an ice skate.

16. The skate of claim 12, wherein the locking teeth are integrally formed with the second end of the holder frame.

* * * * *